US005433427A

United States Patent [19]

Ishikawa et al.

[11] Patent Number: 5,433,427

[45] Date of Patent: Jul. 18, 1995

[54] SHEET CONTAIN DEVICE WITH REFERENCE MEMBER AND REGULATING MEMBER TO POSITION SHEETS

[75] Inventors: Noriyoshi Ishikawa, Yokohama; Yoshinori Sugiura, Kawasaki; Takeshi Niimura, Musashino, all of Japan

[73] Assignee: Canon Kabushiki Kaisha, Tokyo, Japan

[21] Appl. No.: 186,332

[22] Filed: Jan. 25, 1994

[30] Foreign Application Priority Data

Apr. 28, 1993 [JP] Japan ..... 5-123113

[51] Int. Cl.[6] ..... B65H 1/08

[52] U.S. Cl. ..... 271/126; 271/240; 271/250; 271/251; 271/255; 271/171

[58] Field of Search ..... 271/126, 127, 248, 251, 271/253, 255, 171, 223, 240, 250

[56] References Cited

U.S. PATENT DOCUMENTS

| | | | |
|---|---|---|---|
| 5,284,333 | 2/1994 | Ishikawa | 271/251 X |
| 5,290,021 | 3/1994 | Murooka et al. . | |

FOREIGN PATENT DOCUMENTS

| | | | |
|---|---|---|---|
| 131642 | 8/1982 | Japan | 271/171 |
| 51424 | 3/1986 | Japan | 271/171 |
| 66030 | 3/1988 | Japan | 271/171 |
| 17031 | 1/1993 | Japan . | |
| 186059 | 7/1993 | Japan | 271/171 |

*Primary Examiner*—H. Grant Skaggs
*Attorney, Agent, or Firm*—Fitzpatrick, Cella, Harper & Scinto

[57] ABSTRACT

The present invention provides a sheet feed device having a sheet supporting device for supporting a sheet, a regulating member for regulating both one lateral edge and a rear edge of the sheet, and a positioning device for positioning the regulating member in a position depending upon the size of the sheet supported by the sheet supporting device.

22 Claims, 11 Drawing Sheets

SHEET CONTAIN DEVICE WITH REFERENCE MEMBER AND REGULATING MEMBER TO POSITION SHEETS

BACKGROUND OF THE INVENTION

1. Field of the Invention

The present invention relates to a sheet feed device used with a recording apparatus such as a copying machine, a printer, a facsimile machine and the like in which an image is formed on a recording medium such as a paper sheet, an OHP sheet, an envelope or the like.

2. Related Background Art

As an example of conventional arts, a sheet cassette used in a sheet feed device is shown in FIG. 14. This cassette is usually called as a "universal cassette" which can accommodate plural kinds of sheets having different sizes. That is to say, the cassette has width regulating members 101 for regulating widths of sheets in a direction (sheet widthwise direction) perpendicular to a recording sheet convey direction, depending upon the sizes of the sheets, and a rear regulating member 102 for regulating the sheets in the sheet convey direction (sheet longitudinal direction), and these members can be selectively and independently positioned in their predetermined positions in accordance with the size of the sheet.

However, with this arrangement, whenever the sizes of the sheets are exchanged, the user must shift or rearrange both positioning members 101 and 102. If the user forgets to shift the positioning members, the conveying accuracy for the recording sheet will be worsened. Further, since the plurality of such positioning members are provided, the manufacturing cost of the device is increased.

SUMMARY OF THE INVENTION

The present invention aims to eliminate the above-mentioned conventional drawbacks, and has an object to provide a sheet feed device which can simultaneously regulate positions of the stacked recording sheets both of in a sheet widthwise direction and a sheet longitudinal direction when the sheets are exchanged.

According to the present invention, there is provided a sheet feed device comprising sheet supporting means for supporting a sheet, a regulating member for regulating both one lateral edge and a rear edge of the sheet, and positioning means for positioning the regulating member in a position depending upon the size of the sheet supported by the sheet supporting means.

According to another aspect of the present invention, there is provided a sheet feed device comprising sheet supporting means for supporting a sheet, sheet supply means for feeding out the sheet supported by the sheet supporting means, reference means having a reference surface for guiding one lateral edge of the sheet when the sheet is fed out by the sheet supply means, urging means for urging the other lateral edge of the sheet supported by the sheet supporting means toward the reference surface, and a rear end regulating member for regulating a rear end of the sheet supported by the sheet supporting means. Wherein the urging means and the rear end regulating member are integrally formed.

According to a further aspect of the present invention, there is provided a sheet feed device comprising sheet supporting means for supporting a sheet, sheet supply means for feeding out the sheet supported by the sheet supporting means, reference means having a reference surface for guiding one lateral edge of the sheet when the sheet is fed out by the sheet supply means, separation means provided at the side of the reference means and adapted to separate the sheet fed out by the sheet supply means, and regulating means integrally including an urging means for urging the other lateral edge of the sheet supported by the sheet supporting means toward the reference surface and a rear end regulating member for regulating a rear end of the sheet supported by the sheet supporting means. Wherein the regulating means and the separation means are arranged on both sides of a diagonal line of the sheet supported by the sheet supporting means.

With this arrangement, since one lateral edge and rear end of the sheet supported by the sheet supporting means are positioned by the single regulating means, the operability such as the setting of the sheets can be improved, and the cost can be reduced due to the reduction of the number of parts. Further, since the both of one lateral edge and the rear end of the sheet can be regulated only by aligning the regulating means with one rear corner of the sheet, it is possible to eliminate the conventional drawback regarding the poor sheet conveyance caused when the user forgot to shift one or both of the regulating members.

DETAILED DESCRIPTION OF THE PREFERRED EMBODIMENTS

The present invention will now be explained in connection with a sheet feed device according to a preferred embodiment with reference to the accompanying drawings.

First of all, the whole construction of an image forming apparatus including a sheet feed device according to this embodiment will be briefly described with reference to FIGS. 1 and 2. Incidentally, FIG. 1 is a sectional view of a laser beam printer (as an example of the image forming apparatus) to which a process cartridge is mounted, and FIG. 2 is a perspective view of the printer.

Figure 1:
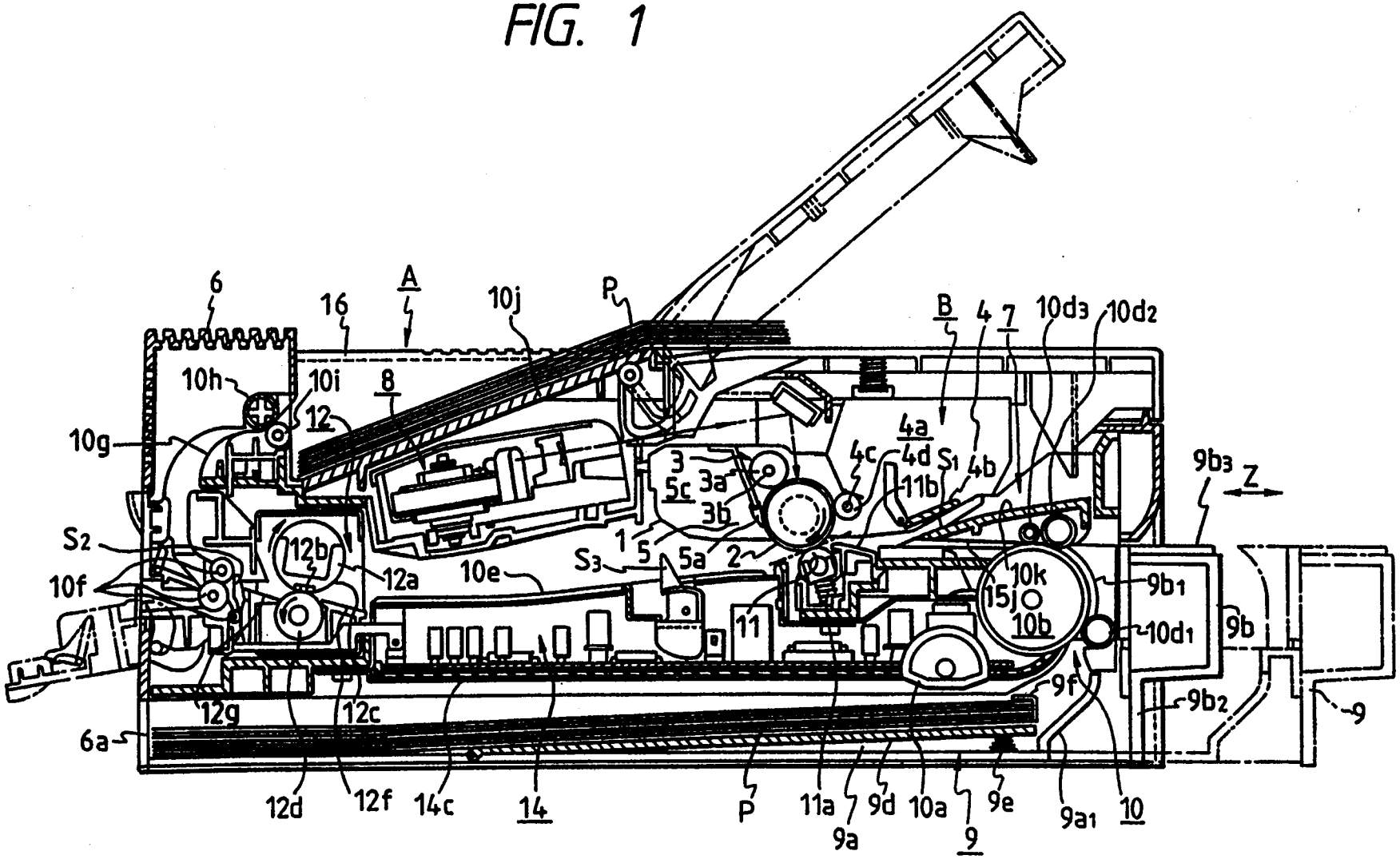
FIG. 1 is an elevational sectional view of a printer incorporating a sheet feed device according to a preferred embodiment of the present invention.
Figure 2:
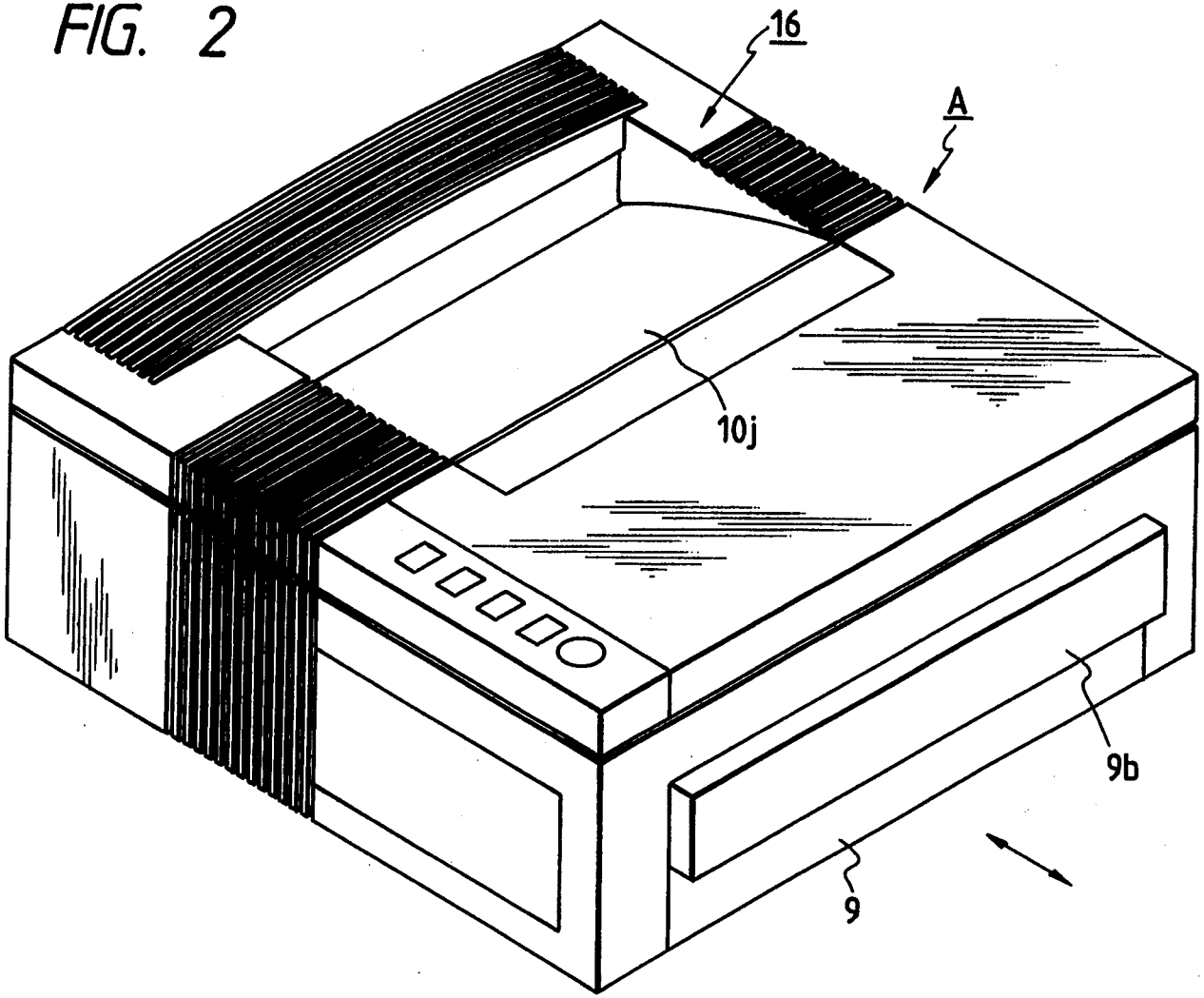
FIG. 2 is a perspective view of the printer of FIG. 1.

As shown in FIG. 1, the image forming apparatus A is of electrophotographic type to which a process cartridge B can be mounted and which is very compact but can record an image on a recording medium (sheet) P. The process cartridge B includes a rotatable photosensitive drum (image bearing member) 2 disposed within a frame 1. Around of the photosensitive drum 2, there are arranged a charge means 3 for uniformly charging a surface of the photosensitive drum 2, a developing means 4 for developing a latent image formed on the photosensitive drum 2 (by illuminating the light image thereon in response to image information) with developer (referred to as "toner" hereinafter) to visualize the latent image as a toner image, and a cleaning means 5 for removing the residual toner remaining on the photosensitive drum 2 after the toner image was transferred to the sheet P. These elements 2 to 5 are integrally held by the frame 1 to form a cartridge.

On the other hand, the image forming apparatus A has a mounting means 7 for mounting the process cartridge B in a body 6 of the apparatus. An optical system 8 for illuminating the light image onto the photosensitive drum 2 in response to the image information is arranged within the body 6 of the apparatus at its upper portion. Further, a loading portion 6*a* to which a sheet cassette 9 containing the sheets P can be loaded is provided within the body of apparatus at its lower portion, so that the sheets P in the sheet cassette 9 loaded in the apparatus can be fed out one by one by a convey means 10.

Further, a transfer means 11 for transferring the toner image formed on the photosensitive drum 2 onto the sheet P is arranged so that when the process cartridge is mounted to the image forming apparatus the photosensitive drum can be opposed to the transfer means. At a downstream side of the transfer means 11 in a sheet convey direction, there is arranged a fixing means 12 for fixing the transferred toner image to the sheet P.

Further, an electric unit 14 for controlling the drive of a main motor (not shown) and the like is arranged above the cassette 9. These elements 11, 12, 14 are assembled and attached to a frame of the apparatus and are covered by an outer cover 16.

Next, various elements of the process cartridge B and of the image forming apparatus A (to which the process cartridge is mounted and which can form the image) will be fully explained.

First of all, regarding the various elements of the process cartridge B, the photosensitive drum 2, charge means 3, developing means 4 and cleaning means will be fully described in order.

The photosensitive drum 2 is constituted by a cylindrical drum base made of aluminium, and an organic photosensitive layer coated on an outer peripheral surface of the drum base. The photosensitive drum 2 is rotatably mounted on the frame 1. By transmitting a driving force from the main motor of the image forming apparatus to a gear secured to one longitudinal end of the photosensitive drum 2, the photosensitive drum 2 is rotated in a direction shown by the arrow in FIG. 1 in response to the image forming operation.

The charge means 3 is of a so-called "contact charge" type wherein a charge roller 3*a* rotatably mounted on the frame 1 is contacted with the photosensitive drum 2. The charge roller 3*a* comprises a conductive elastic layer mounted on a metallic roller shaft 3*b*, a high resistive elastic layer coated on the conductive layer, and a protection layer coated on the high resistive layer. The conductive elastic layer is formed by dispersing carbon in an elastic rubber layer made of EPDM, NBR or the like and serves to guide a bias voltage applied to the roller shaft 3*b*. The high resistive elastic layer is made of urethane rubber or the like (as an example, including a small amount of pulverized conductive powder) and serves to prevent the abrupt reduction of the bias voltage by restricting the leak current to the photosensitive drum 2 even if the high conductive charge roller is opposed to the pinhole of the photosensitive drum 2. Further, the protection layer is made of N-methyl methoxy nylon and serves to prevent the deterioration of the surface of the photosensitive drum 2 even if the plastic materials of the conductive elastic layer and the high resistive elastic layer contact with the photosensitive drum 2.

The charge roller 3*a* is contacted with the photosensitive drum 2. During the image formation, the charge roller 3*a* is rotated by the rotation of the photosensitive drum 2, during which the bias voltage obtained by overlapping a DC voltage with an AC voltage is applied to the charge roller 3*a*, thereby uniformly charging the surface of the photosensitive drum 2.

The developing means 4 has a toner reservoir 4*a* for containing the toner, in which a toner feed member 4*b* reciprocally shifted in a direction shown by the arrow to feed out the toner is provided. The developing means also has a magnet 4*c* therein, and further has a developing sleeve 4*d* for forming a thin toner layer thereon by its own rotation, which developing roller is opposed to the photosensitive drum 2 with a small gap therebetween. When the toner layer is being formed on the surface of the developing sleeve 4*d*, the frictionally charged charges sufficient to develop the electrostatic latent image on the photosensitive drum 2 is obtained by the friction between the toner and the developing sleeve 4*d*.

The cleaning means 5 comprises a cleaning blades 5*a* contacted with the surface of the photosensitive drum 2 and adapted to scrape or remove the residual toner remaining on the photosensitive drum 2, a dip sheet (not shown) disposed below the blade 5*a* to receive the removed toner and lightly contacted with the surface of the photosensitive drum 2, and a waste toner reservoir 5*c* for correcting the waste toner from the dip sheet.

Figure 3:
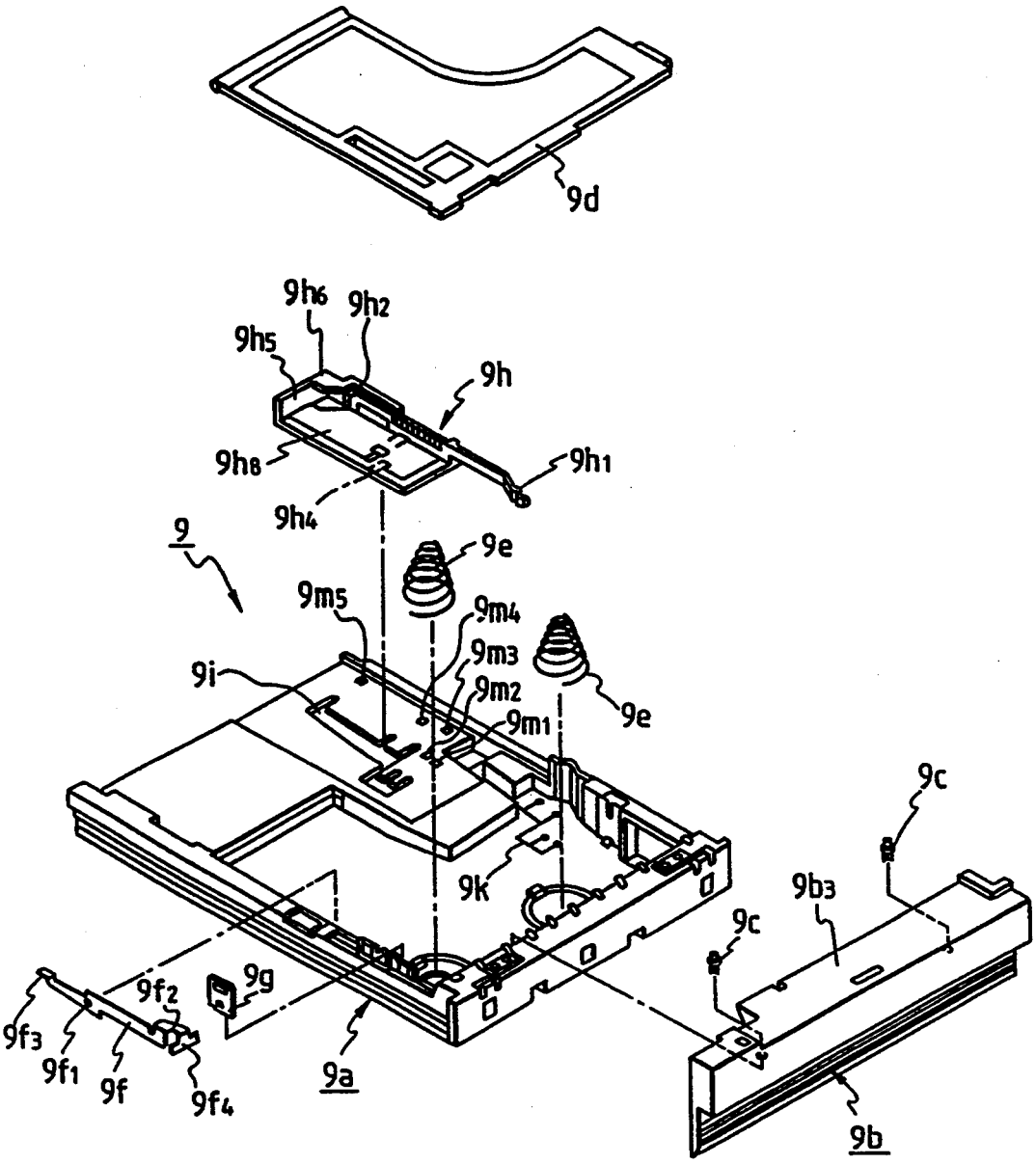
FIG. 3 is an exploded perspective view of a sheet cassette used with the sheet feed device of FIG. 1.

Next, the construction of the sheet cassette 9 will be explained. As shown in FIG. 1, the loading portion 6*a* to which the sheet cassette 9 can be loaded is provided within the body 6 of the image forming apparatus at its lower portion. The sheet cassette 9 containing the sheets P is inserted into the loading portion 6*a* from a direction shown by the arrow Z in FIG. 1. As shown in FIG. 1, the sheet cassette 9 comprises a cassette body 9*a* having a guide portion 9*a*1 for guiding the conveyed sheet P, and a cassette outer portion 9*b* formed independently from the cassette body 9*a* and comprised of a convey guide portion 9*b*1, a cassette outer surface 9*b*2 and a manual insert guide portion 9*b*3 providing a tray for a manually inserted sheet P. As shown in FIG. 3, the cassette body 9a and the cassette outer portion 9b are interconnected by ribets 9c.

Incidentally, when the sheet cassette 9 is mounted to the body 6 of the image forming apparatus, only the cassette outer portion 9b is exposed out of the body 6. Thus, only by changing the cassette outer portion 9b, the sheet cassette 9 can be modified to match the design of the body 6 of the image forming apparatus.

Figure 4:
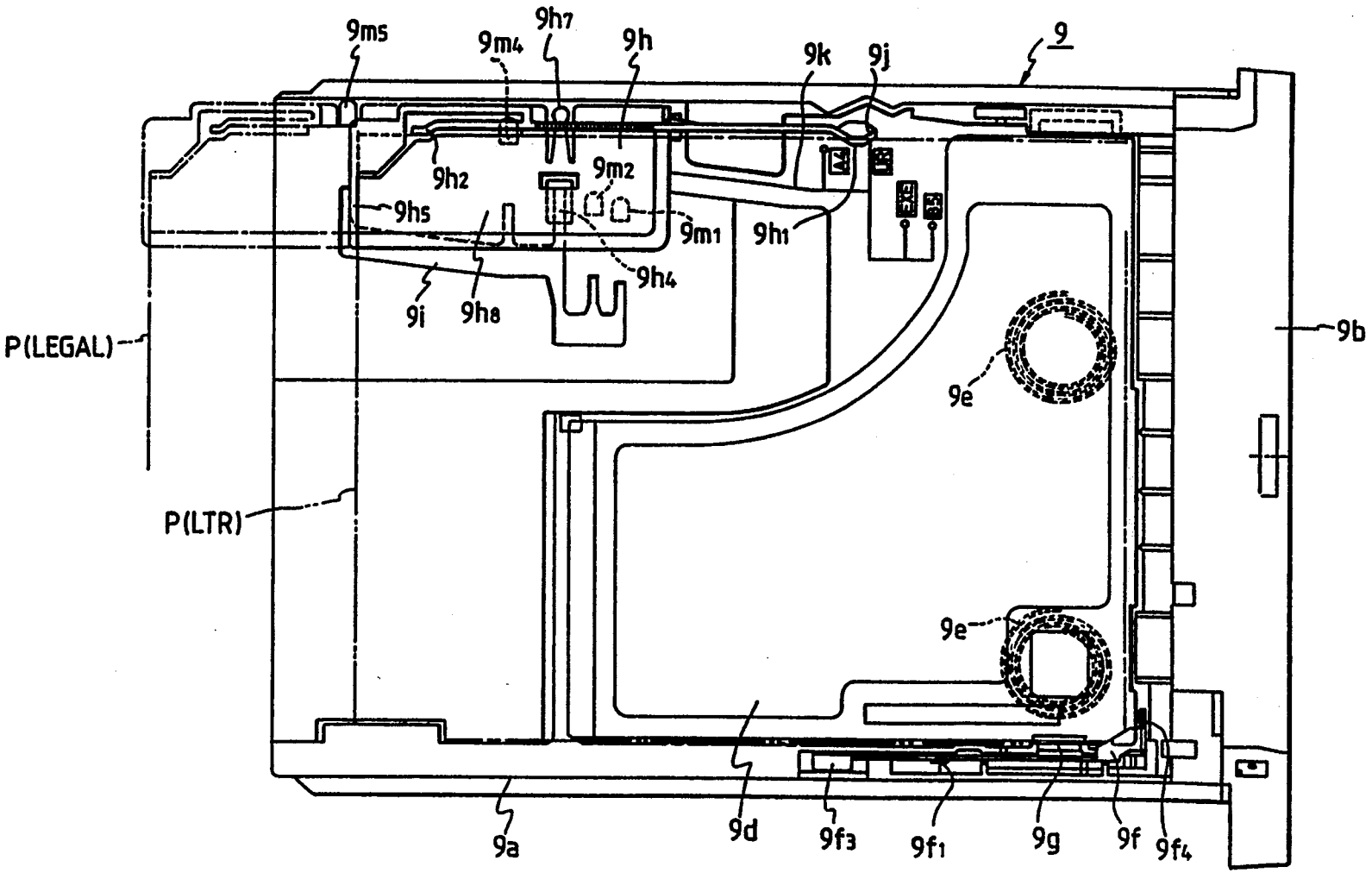
FIG. 4 is a plan view of a sheet cassette of FIG. 3 when sheets having letter (LTR) size are contained therein.

As shown in FIGS. 3 and 4, within the cassette body 9a, there are arranged an intermediate plate 9d on which the sheets P are stacked, springs 9e for urging the intermediate plate 9d upwardly, and a separation pawl 9f for regulating a front corner (at the reference side) of the sheet stack P rested on the intermediate plate 9d so that the sheets can be separated one by one when the sheets are supplied.

The separation pawl 9f has a hole 9f1 by which the separation pawl is rotatably mounted on a separation pawl attachment shaft (not shown) formed on the cassette body 9a, so that the separation pawl can be pivoted around the attachment shaft in response to the movement of the front corner of an uppermost sheet on the sheet stack P. The separation pawl 9f also has a separation portion 9f2 for separating the sheets stacked on the intermediate plate 9d one by one. The separation pawl 9f further has an urging portion 9f3 for lifting the separation portion 9f2, which urging portion is positioned at a side of the separation pawl opposite to a side on which the separation portion 9f2 is provided. By setting the sheet stack P in the sheet cassette 9 while urging the urging portion 9f3, the sheets P can easily be set in the cassette since the separation portion 9f2 is lifted upwardly. Further, the separation pawl 9f has a regulating portion 9f4 for regulating the leading end or tip end of the sheet stack.

Further, in the proximity of the separation pawl 9f provided in the cassette body 9a, there is arranged a metallic reference plate 9g with which a lateral edge of the sheet stack is contacted. When the sheets are supplied from the sheet cassette 9 by a pick-up roller 10a, the lateral edges of the sheets are guided along the reference plate 9g.

Further, as shown in FIG. 4, in the proximity of a corner of the cassette body 9a opposed to the separation pawl 9f, there is provided a shiftable regulating member 9h for regulating a rear end and the other lateral edge (opposite to the reference plate 9g) of the sheet stack P to enable the handling of various kinds of sheets having different sizes.

Now, the construction of the regulating member 9h will be explained with reference to FIGS. 3 to 8.

The regulating member 9h molded from synthetic resin material having the good anti-creep feature such as polycarbonate, polyallylate or the like.

The regulating member 9h has first and second arm-shaped lateral edge urging portions 9h1, 9h2 for urging the lateral edge of the sheet stack P toward the reference plate to permit stable supplying of the sheets from the sheet cassette 9. The first and second lateral edge urging portions 9h1, 9h2 provide the urging force by utilizing the spring feature of the synthetic resin material. Further, the regulating member 9h has a rear end urging portion 9h5 for regulating the position of the rear end of the sheet stack P, a sheet number limiting portion 9h6 for limiting the number of sheets P to be stacked, and a positioning mechanism for positioning the regulating member 9h in the cassette body 9a.

Figure 7A:
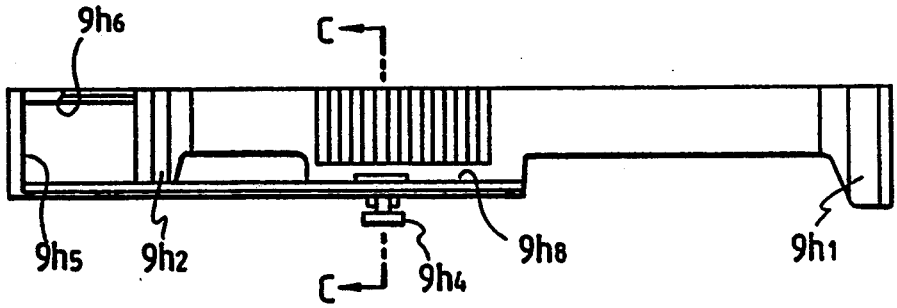
FIG. 7A is a front view of the regulating member of FIG. 6.
Figure 7B:
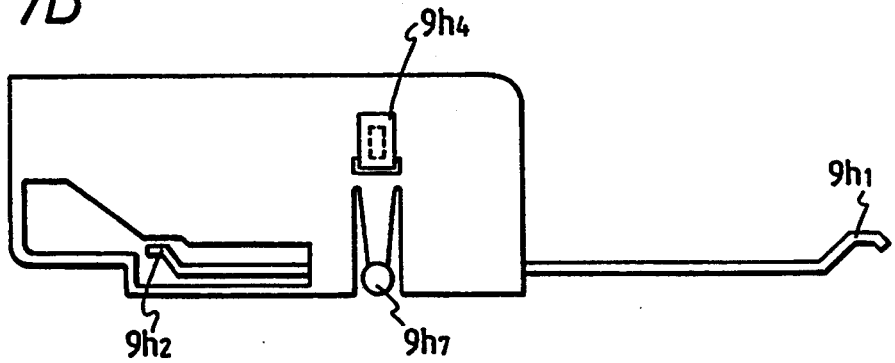
FIG. 7B is a back view of the regulating member of FIG. 7A.
Figure 7C:
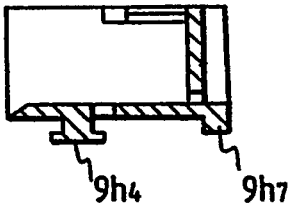
FIG. 7C is a sectional view taken along the line C—C of FIG. 7A.

The positioning mechanism comprises an engagement portion 9h4 slidably engaged by a locking groove 9i formed in the cassette body 9a, and positioning bosses 9h7 fitted into positioning holes 9m1 to 9m5 (FIGS. 4 and 5) formed in the cassette body 9a and adapted to position the regulating member 9h at a predetermined position. The engagement portion 9h4 is shiftable along the locking groove 9i so that the regulating member 9h can be shifted to a position corresponding to the size of the sheet P without disassembling the regulating member 9h from the cassette body 9a. Since the engagement portion 9h4 has a flange having a width greater than a width of the locking groove 9i, the regulating member 9h is not disengaged from the cassette body 9a. Further, as shown in FIG. 7B, since notches are formed on both sides of each positioning boss 9h7, the positioning bosses can easily be deformed elastically to fit into the corresponding positioning holes 9m1 to 9m5, thereby fixing the regulating member in the position corresponding to the size of the sheet.

Figure 5:
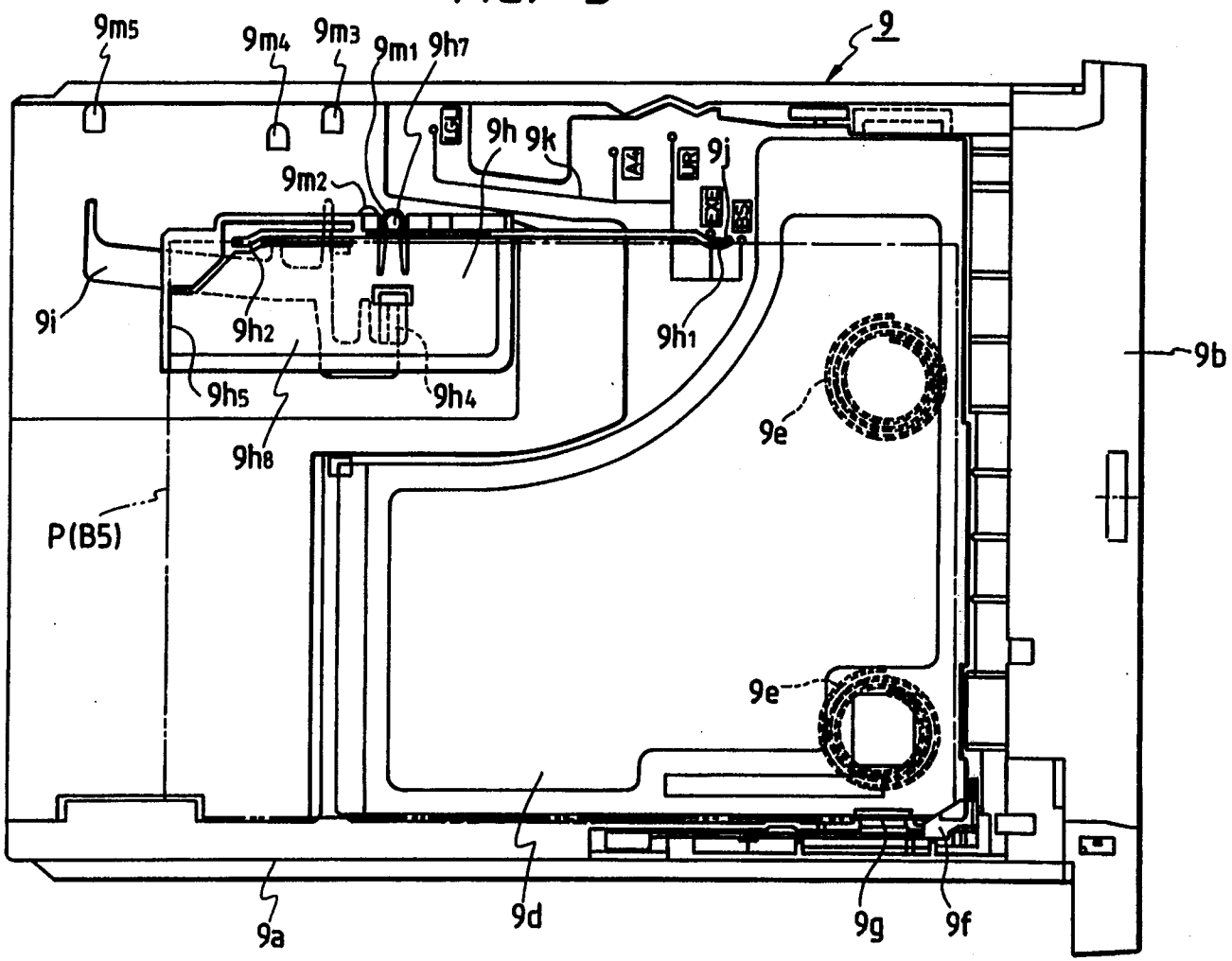
FIG. 5 is a plan view of a sheet cassette of FIG. 3 when sheets having B5 size are contained therein.
Figure 6:
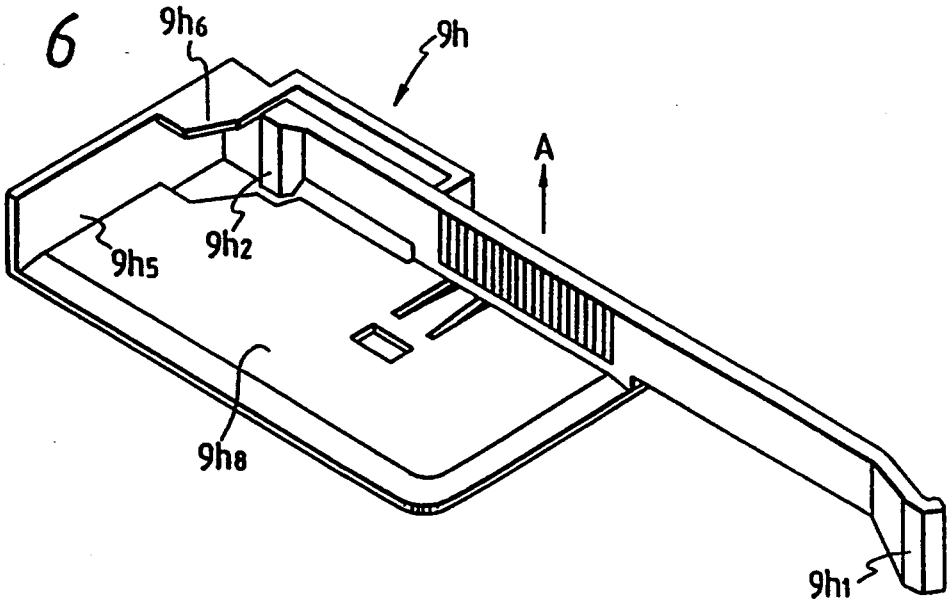
FIG. 6 is a perspective view of a regulating member provided on the sheet cassette of FIG. 3.

In the illustrating embodiment, the sizes of the sheets to be used are the following five sizes: that is, B5 size, EXECUTIVE size, LTR (letter) size, A4 size and LEGAL size. FIG. 4 shows a condition that the sheets P having LEGAL size are contained in the cassette, and FIG. 5 shows a condition that the sheets having B5 size are contained in the cassette. When the sheets P having LEGAL size are loaded, as shown by the dot and chain line in FIG. 4, the regulating member 9h is attached to the cassette body so that a portion of the regulating member is protruded from the rear end of the cassette body 9a. By shifting the regulating member 9h in this way, it is possible to accommodate the sheets P having the length longer than the cassette body 9a. When the sheets P having such size are contained in the cassette, the rear end portion of the sheet stack P is supported by a floor surface 9h8 of the regulating member 9h.

Figure 8:
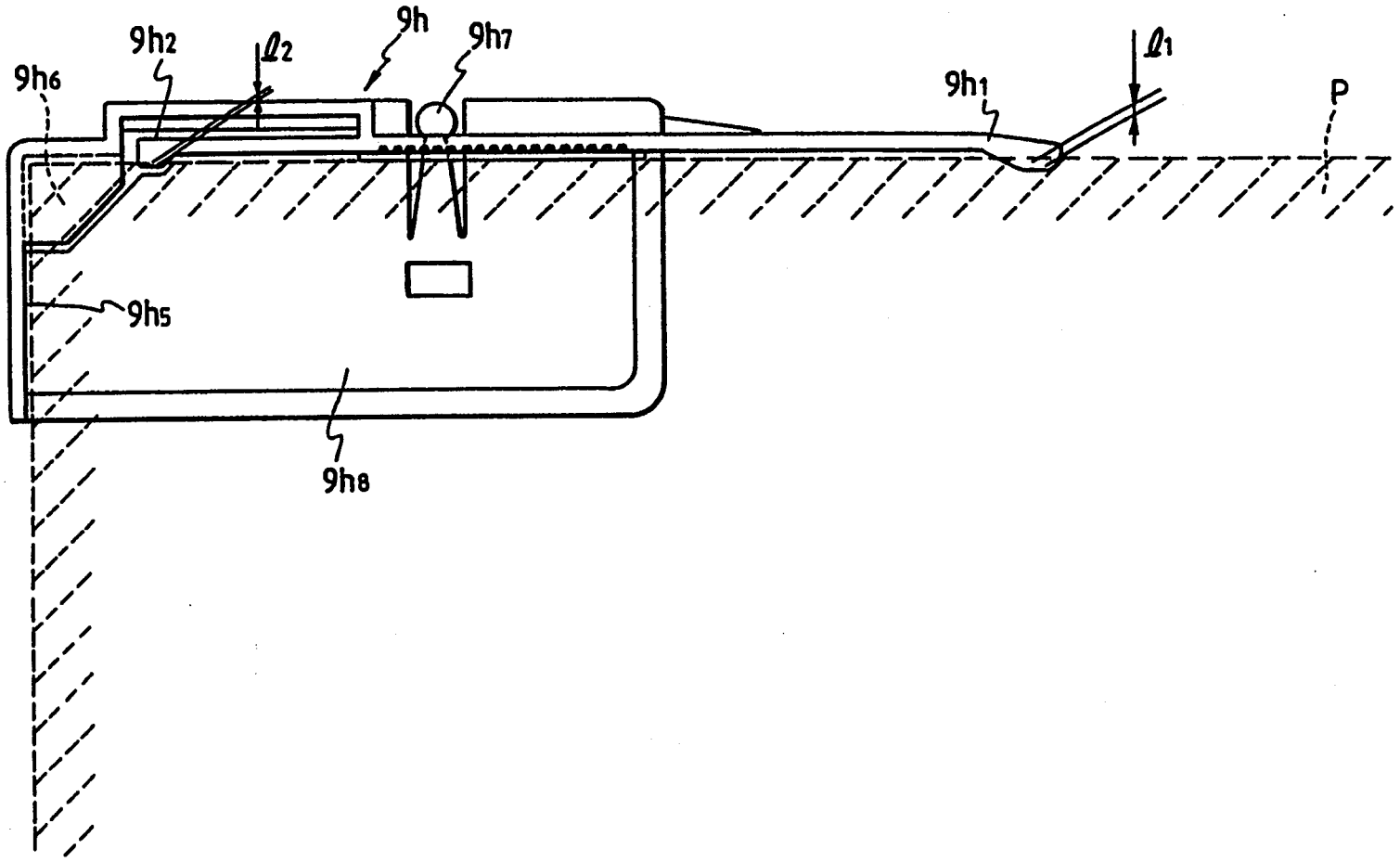
FIG. 8 is a view showing deflection amounts of lateral edge urging portions of the regulating member of FIG. 6.

As shown in FIG. 8, deflection amounts $l_1$, $l_2$ of the first and second lateral edge urging portions 9h1, 9h2 are set so that they are varied in accordance with the sizes of the sheets P, thereby providing the proper urging force to the sheet stack P. In the illustrated embodiment, in case of the sheets having relatively narrow widths such as B5 size and EXECUTIVE size, the deflection amount $l_1$ of the first lateral edge urging portion 9h1 is set to 1.5 mm, and the deflection amount $l_2$ of the second lateral edge urging portion 9h2 is set to 1 mm. On the other hand, in case of the sheets having relatively wide widths such as LTR size, A4 size and LEGAL size, the deflection amount $l_1$ of the first lateral edge urging portion 9h1 is set to 2.5 mm, and the deflection amount $l_2$ of the second lateral edge urging portion 9h2 is set to 2 mm.

In this way, by varying the deflection amounts $l_1$, $l_2$ of the first and second lateral edge urging portions 9h1, 9h2 in accordance with the sizes of the sheets to be contained, the convey ability for the sheet P can be stabilized. That is to say, regarding the wide (for example, 210 mm) sheets, the buckling ratio that the last sheet P is buckled in the widthwise direction by the first lateral edge urging portion 9h1 is 2.5/210. If the narrow (for example, 182 mm) sheet is urged by the same deflection amount, the buckling ratio will become considerably great (as 2.5/182). To avoid this, regarding the narrow sheets P, by varying the deflection amount of the first lateral edge urging portion 9h1 to 1.5 mm, the buckling ratio is decreased. In this way, by varying the deflection amounts, $l_1$, $l_2$ of the first and second lateral edge urging portions 9h1, 9h2, the sheets P can be urged by the optimum urging force. The deflection amounts $l_1$, $l_2$ can advantageously be set by the positional relation between the engagement portion 9h4 and the locking groove 9i and the positional relation between the positioning bosses 9h7 and the positioning holes 9m1 to 9m5.

Further, the reason why the deflection amount of the first lateral edge urging portion 9h1 is set to be greater than the deflection amount of the second lateral edge urging portion 9h2 is as follows.

Figure 9:
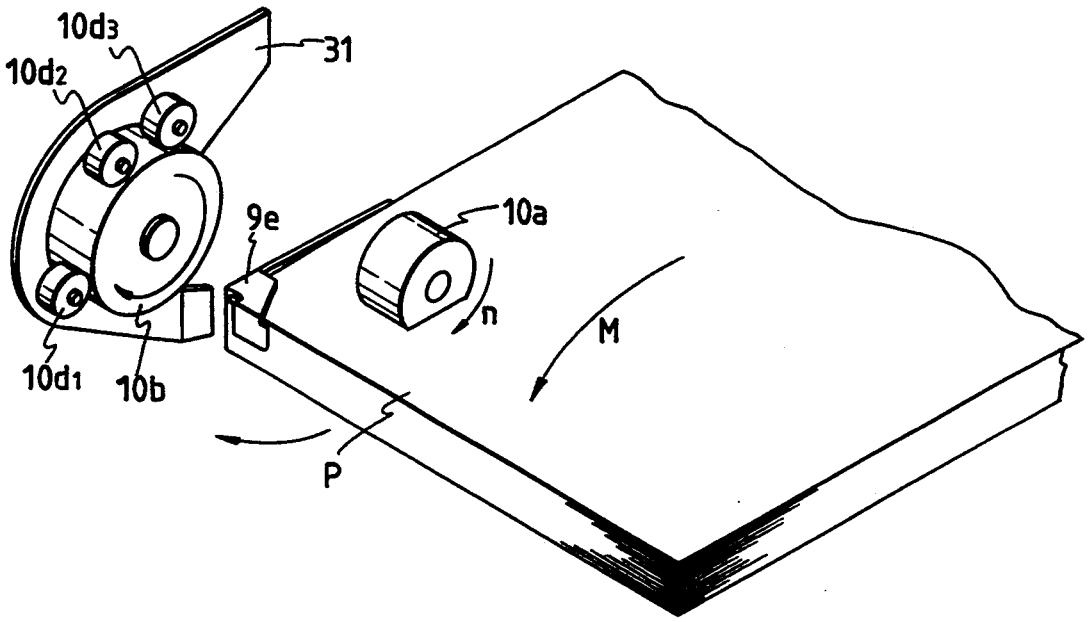
FIG. 9 is a perspective view showing a convey roller and small rollers of a sheet convey means of the printer of FIG. 1.

In the illustrated embodiment, as shown in FIG. 9, since the separation pawl 9f is associated with only one of front corners of the sheet stack P contained in the sheet cassette 9 and the pick-up roller 10a is arranged to offset toward the separation pawl 9f, the supplied sheet P tends to rotate in a direction shown by the arrow M in FIG. 9 by the great supplying force of the pick-up roller 10a. If the deflection amount of the second lateral edge urging portion 9h2 is great, such tendency will be enhanced so that it is feared that the sheet P is supplied while rotating greatly. To avoid this, by setting the deflection amount of the first lateral edge urging portion 9h1 to become greater than the deflection amount of the second lateral edge urging portion 9h2, such undesirable rotation of the sheet is supppressed.

Further, sheet size indications 9k are provided on the bottom surface of the cassette body 9a. By slidingly shifting the regulating member 9h to align a sheet size index 9j provided on a free end of the first lateral edge urging portion 9h1 with one of the size indications 9k, the regulating member 9h can easily be set to the position corresponding to the size of the sheet to be used. Further, by observing the sheet size indication 9k pointed by the sheet size index 9j, the size of the sheets P contained in the sheet cassette can easily be as certained.

In the illustrated embodiment, while the regulating member 9h was integrally formed by the molding, various elements or portions of the regulating member may be formed independently and these elements may be interconnected with each other to form the whole regulating member.

Returning now to FIG. 1, the sheet convey means 10 will be explained. The sheet convey means 10 serves to supply the sheets contained in the sheet cassette 9 to an image forming portion and to further convey the sheet through the fixing means 12 to a discharge portion 10j. That is to say, when the sheet cassette 9 is mounted to the image forming apparatus and the sheet supply is started, the pick-up roller 10a is rotated to separate the sheets P in the sheet cassette 9 one by one from the uppermost one and supply the separated sheet. The supplied sheet P is passed through a first reverse rotation sheet path comprising a convey roller 10b, small rollers 10d1, 10d2, 10d3 and the like to be turned up and then is sent to the rear portion of the apparatus. Then, the sheet P is conveyed to a nip between the photosensitive drum 2 and the transfer roller 11, where the toner image formed on the photosensitive drum 2 is transferred onto the sheet. The sheet P to which the toner image was transferred is guided by a cover guide 10e formed on the electric unit 14 to be sent to the fixing means 12 where the toner image is fixed to the sheet. After the sheet leaves the fixing means 12, the sheet P is sent through a relay convey roller 10f to a second arcuated reverse rotation sheet path 10g. While the sheet is passed through the second reverse rotation sheet path 10g, the sheet P is turned up again and then is sent to the discharge portion 10j provided above the optical system 8 and the mounted process cartridge B by a pair of discharge rollers 10h, 10i.

Now, a sheet supply unit for conveying the sheet from the sheet cassette 9 to the image forming portion will be explained with reference to FIGS. 9 to 13. The above-mentioned small rollers 10d1, 10d2, 10d3 are slightly inclined with respect to a shaft of the convey roller 10b by skew-feed angles of $\alpha_1$, $\alpha_2$, $\alpha_3$, respectively so that the sheet P is subjected to a skew-feed force for shifting the sheet laterally toward a reference surface 31 of the convey guide on the basis of these skew-feed angles. Incidentally, as shown in FIG. 9, the convey roller 10b does not have a length corresponding to the whole width of the sheet P but has a small length in the vicinity of the guide reference surface 31 for the sheet P.

Further, the skew-feed angles $\alpha_1$, $\alpha_2$, $\alpha_3$ are obtained by measuring such angles on a peripheral surface of an imaginary cylinder which has a central axis coincident with the axis of the convey roller 10b and passes through the centers of the small rollers 10d1, 10d2, 10d3. In the illustrated embodiment, for example, angles $\alpha_1$, $\alpha_2$, $\alpha_3$ are set to about 0.5 degree, 4 degrees and 4 degrees, respectively. Further, the urging forces of the small rollers 10d1, 10d2, 10d3 against the convey roller 10b are about 400 grams in total, and the skew-feed force (caused by the small rollers 10d1, 10d2, 10d3) for shifting the sheet P laterally is set to about 150 grams.

Figure 10:
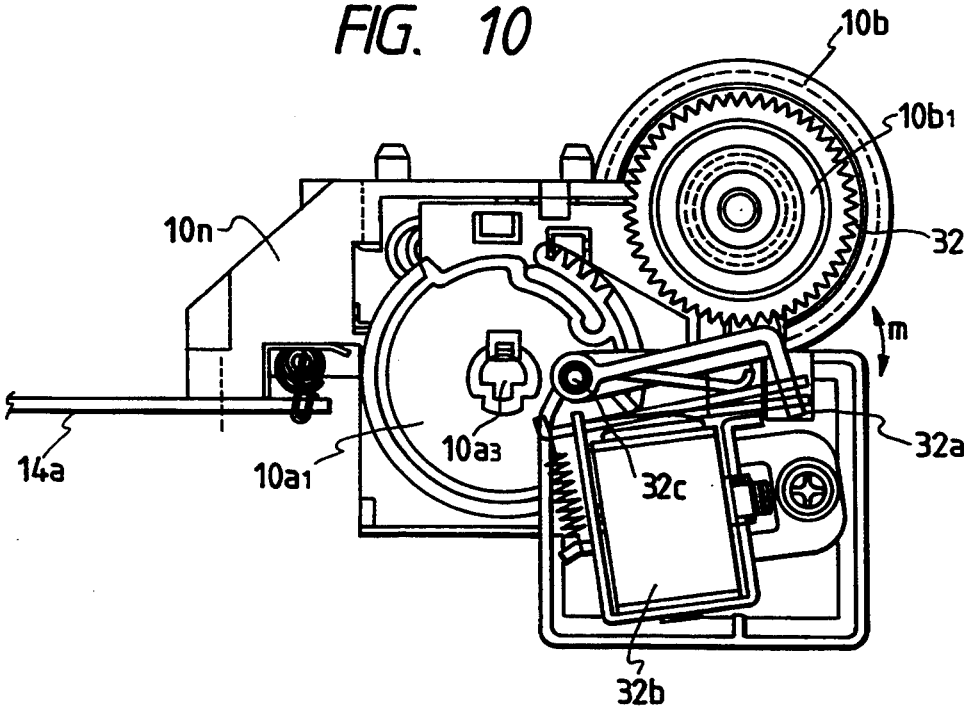
FIG. 10 is a sectional view showing a sheet supply unit associated with the sheet convey means.

A main motor is arranged within the body of the image forming apparatus, and a gear train is arranged to engage by a convey gear 10b1 and a pick-up gear 10a1 as shown in FIG. 10. In particular, a gear engaging with the pick-up gear 10a1 is so arranged that an engagement portion of the gear is opposed to a notched portion or non-toothed portion of the pick-up gear 10a1. Further, a stopper portion 10a2 of the pick-up roller 10a is caught by a sheet supply roller solenoid (not shown), thereby stopping the pick-up roller.

In FIG. 10, a clutch 32 includes a conventional planetary gear train, in which the transmission of a driving force to the convey roller 10b arranged on a shaft 32c of the clutch 32 is controlled by stopping or rotating a sun gear by rotating a ratch pawl 32a around the shaft 32c in directions shown by the arrow m by means of a solenoid 32b.

Figure 11:
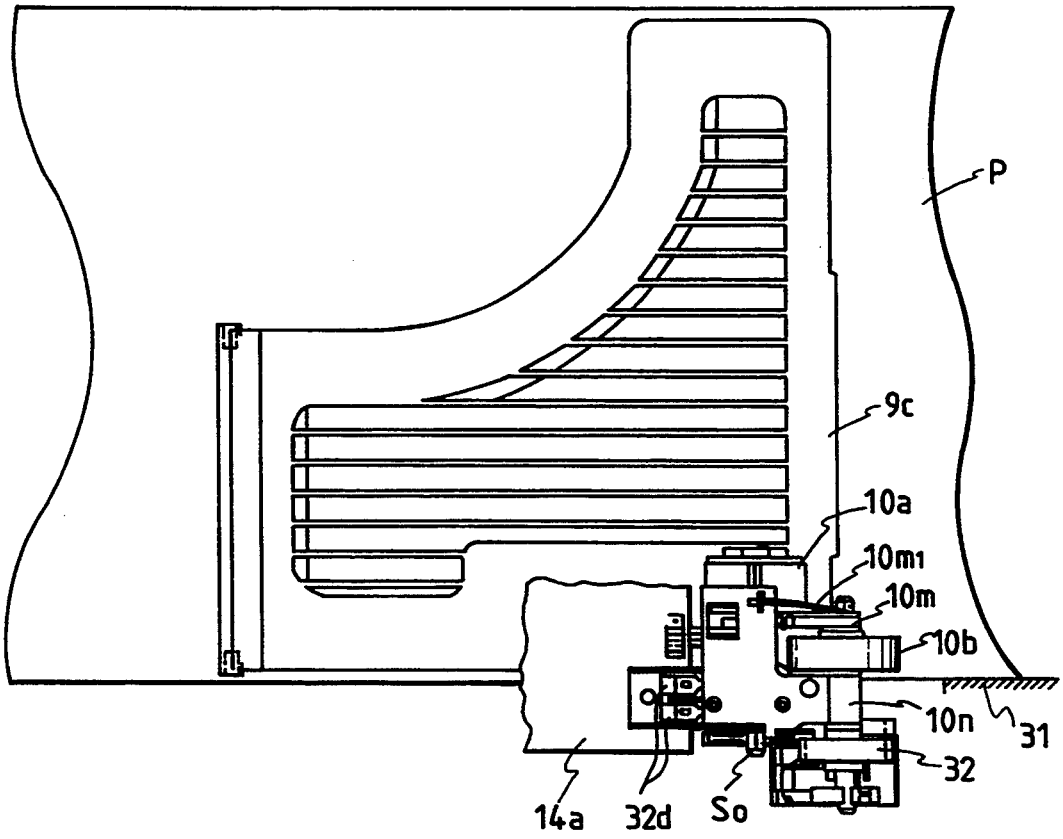
FIG. 11 is a plan view of the sheet supply unit of FIG. 10.
Figure 12:
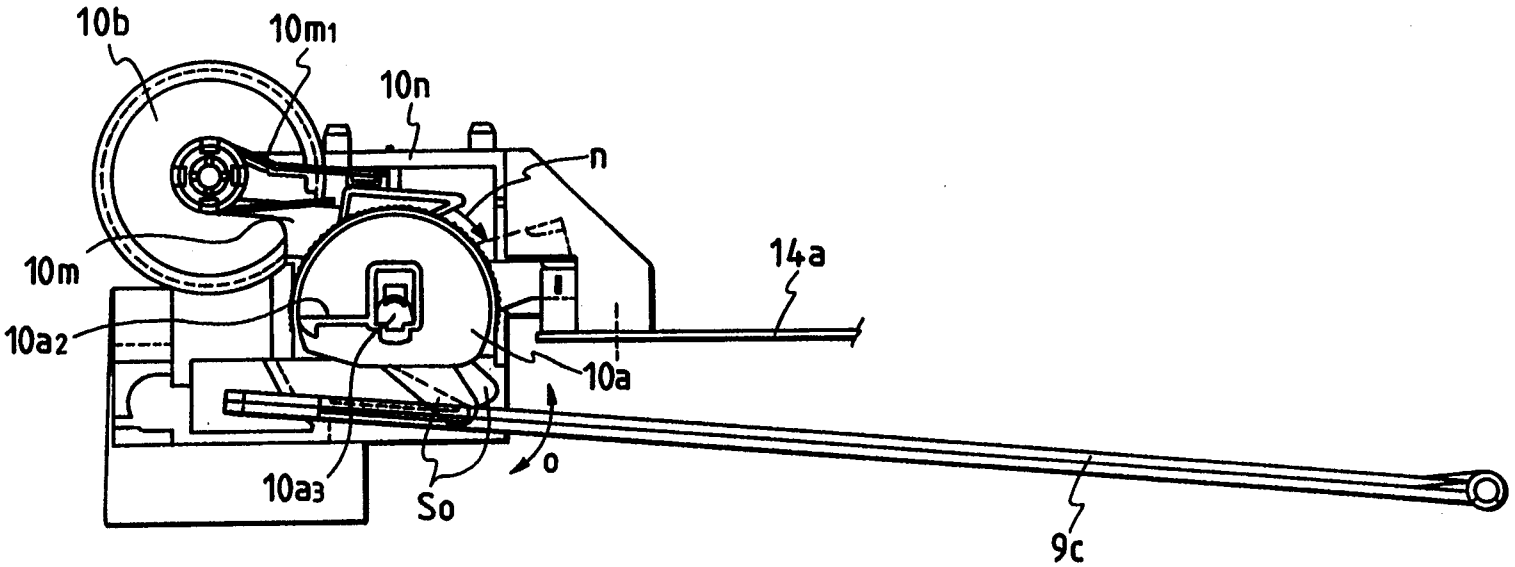
FIG. 12 is a side view of the sheet supply unit of FIG. 10.

Incidentally, as shown in FIG. 11, solenoid terminals 32d are connected to lead wires from the solenoid 32b. Further, the pick-up roller 10a for separating and supplying the sheets P stacked in the sheet cassette 9 one by one is connected to the pick-up gear 10a1 via a roller shaft 10a3.

A convey roller lever 10m rotatably mounted on the shaft of the clutch 32 cooperates with a convey roller lever spring 10m1 to apply an urging force to a cam portion formed on the pick-up roller 10a, thereby applying a rotational force in a direction shown by the arrow n in FIG. 9 to the pick-up roller 10a. A sheet presence/absence detection sensor S0 shown in FIG. 11 is rotated in a direction shown by the arrow o in FIG. 12 when there is no sheet P on the intermediate plate 9d of the sheet cassette 9, thereby detecting the absence of the sheet.

The above-mentioned elements are arranged on a sheet supply frame 10n, and a sensor arm is rotatably mounted on a boss portion of the sheet supply frame 10n. In this-way, the sheet supply unit is constituted.

In the apparatus according to the illustrated embodiment, a convey path for the sheet P is formed as "S"-shaped path by the first reverse rotation sheet path and the second convey sheet path. Thus, it is possible to further reduce the space of the apparatus, and the recorded sheets P are discharged in the discharge portion 10*j* with the imaged surfaces of the sheets facing downwardly in the page order.

Incidentally, as shown in FIG. 1, sensors S1, S2, S3 are arranged in the sheet convey path to detect the presence/absence of the sheet P. The sensor S1 is a regist sensor which can detect a tip end of the sheet P conveyed from the sheet cassette 9 to the transfer roller 11, thereby providing the timing of the writing by the laser in the laser scanner 8 and detecting the presence of the sheets upon the start of the operation of the image forming apparatus.

Figure 13:
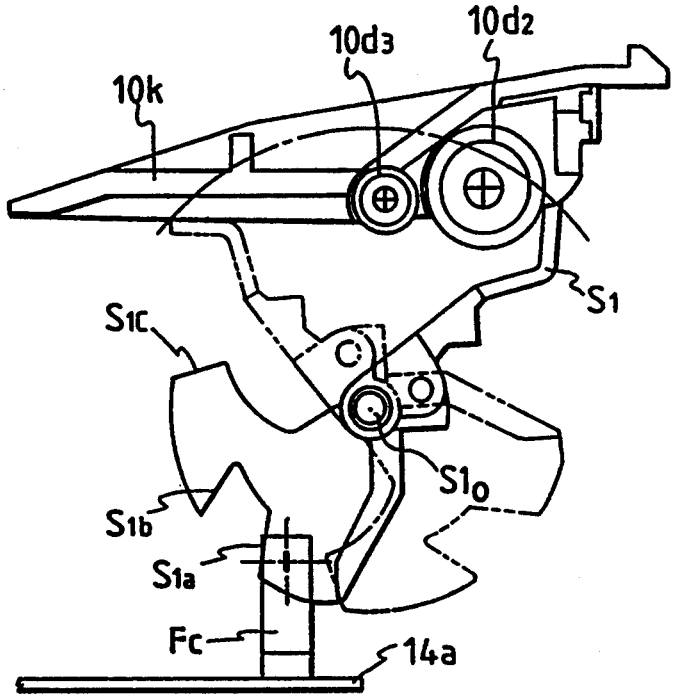
FIG. 13 is a view showing a regist sensor associated with the sheet convey means.
Figure 14:
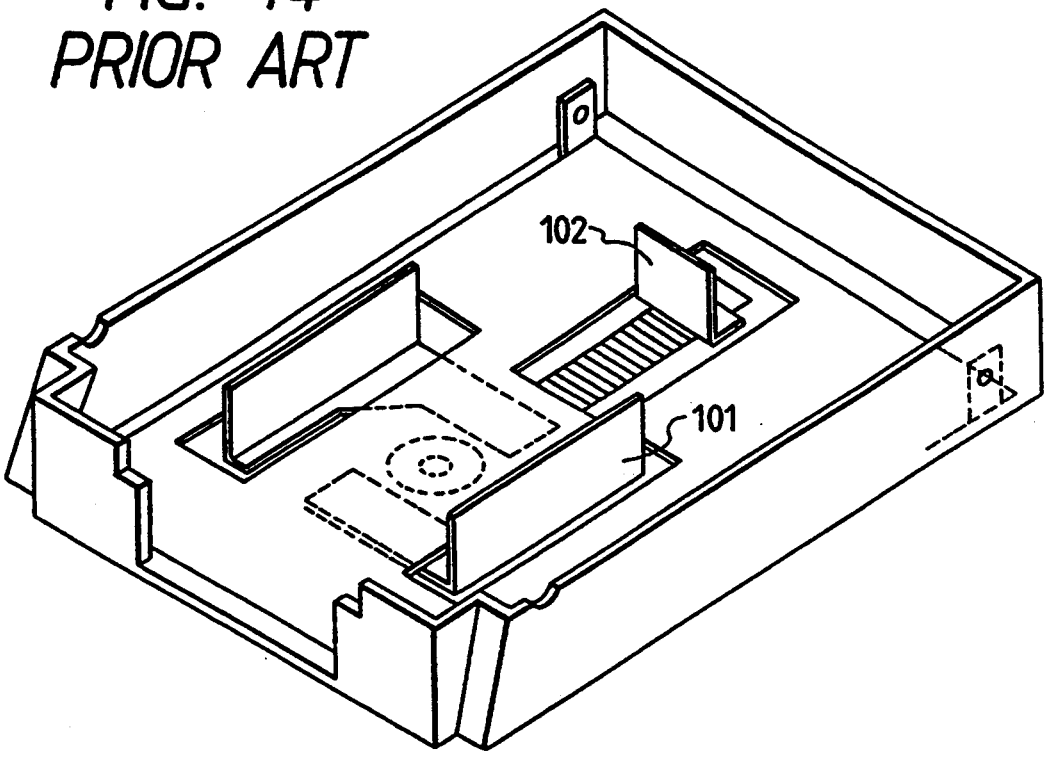
FIG. 14 PRIOR ART
FIG. 14 is a perspective view of a conventional sheet cassette.

Incidentally, as shown in FIG. 13, the regist sensor S1 can be rotated around a shaft S1*o* and has edge portions S1*a*, S1*b*, S1*c* to emit three signals. The edge portion S1*a* can emit the presence/absence signal for the manually inserted sheet. The edge portion S1*b* can emit a position signal representative of a waiting position of the sheet which has previously been picked up. The edge portion S1*c* can emit a signal for providing the timing of the writing by the laser. Such signals are emitted when the edge portions S1*a*, S1*b*, S1*c* are detected by a photo-interrupter FC arranged on the electric substrate 14*a*.

The sensor S2 is a discharge sensor which can detect the passage of the tip end and trailing end of the sheet P sent from the fixing means 12 and detect the presence of the sheets upon the start of the operation of the image forming apparatus. The sensor S3 is a sheet presence/absence detection sensor which is arranged in the sheet path extending from the toner image transferring station to the fixing means to detect the presence/absence of the sheet in such sheet path and which can also detect the opening/closing of a rear cover.

By using such sensors, for example, if the sheet is jammed in the image forming apparatus, a control portion of the apparatus detects the jam of the sheet on the basis of the relation between the sheet supply timing and the signals from the sensors S1, S2, thereby immediately stopping the operation of the apparatus and displaying the jam occurrence.

On the other hand, if the sheet is jammed in the fixing means 12, the control portion counts the time elapsed from the sheet supply timing, and judges the fact that the sheet is jammed in the fixing means 12 when the discharge sensor S2 does not detect the tip end of the sheet even after the time when the tip end of the sheet should reach the discharge sensor has already been elapsed, thereby immediately stopping the operation of the apparatus.

The transfer means 11 serves to transfer the toner image formed on the photosensitive drum 2 in the image forming portion onto the sheet P. As shown in FIG. 1, the transfer means comprises the transfer roller 11. That is to say, the sheet P is urged against the photosensitive drum 2 in the mounted process cartridge B by the transfer roller 11, and the toner image on the photosensitive drum 2 is transferred onto the sheet P by applying a voltage having the polarity opposite to that of the toner to the transfer roller 11. Incidentally, a spring 11*a* serves to urge the transfer roller 11 against the photosensitive drum 2.

Incidentally, a guide member 11*b* is arranged at an upstream side of the transfer roller 11 in the sheet convey direction to stabilize the penetration of the sheet P into the nip between the photosensitive drum 2 and the transfer roller 11. Further, the scattering of the toner is prevented by shielding the surface of the transfer roller 11. Furthermore, the sheet P passed through the nip between the photosensitive drum 2 and the transfer roller 11 is conveyed downwardly by an angle of about 20 degrees with respect to a horizontal direction, thereby ensuring the positive separation of the sheet from the photosensitive drum 2.

As shown in FIG. 1, the fixing means 12 serves to fix the toner image transferred to the sheet P by applying the voltage to the transfer roller 11 onto the sheet P. In the fixing means 12, there is provided a heat-resisting film guide member 12*a* of a trough shape having substantially semi-circular cross-section, and a plate-shaped ceramic heater 12*b* having low heat capacity and arranged below a central portion of the guide member 12*a* along a longitudinal direction of the guide member. Further, a cylindrical (endless) thin film 12*c* made of heat-resisting resin is loosely mounted around the guide member 12*a*. The film 12*c* is constituted by a base layer made of polyimide and having a thickness of about 50 μm, a primer layer having a thickness of about 4 μm, and a coating layer made of fluorine and having a thickness of about 10 μm. The base layer is made of strong material and has the thickness sufficient to resist various stresses and wears applied to the film. The primer layer has a conductive feature by making it of polyamideimide resin and fluororesin (including carbon therein).

A pressure roller 12*d* is arranged below the guide member 12*a*, and the guide member 12*a* is always urged against the pressure roller 12*d* from the above by a spring so that the pressure roller is urged against the ceramic heater 12*d* with the interposition of the film 12*c*. That is to say, the ceramic heater 12*b* and the pressure roller 12*d* constitutes a fixing nip with the interposition of the film 12*c* therebetween. The pressure roller 12*d* comprises a metallic core and a soft silicone rubber layer, and a peripheral surface of the silicone rubber layer is coated by fluorine layer.

A thermistor chip (not shown) is associated with the ceramic heater 12*b* so that the current supply to the ceramic heater is controlled to maintain a predetermined fixing temperature by a temperature adjusting system of the control portion (described later) in response to a thermistor signal. Further, the pressure roller 12*d* has a roller shaft to which a gear is attached so that the pressure roller can be rotated in an anticlockwise direction in FIG. 1 at a predetermined peripheral speed. By the rotation of the pressure roller 12*d*, due to the rotational friction of the roller 12*d*, the cylindrical film 12*c* is closely contacted with the undersurface of the ceramic heater 12*b* in the fixing nip, whereby the film is rotatingly driven around the film guide member 12*a* in a clockwise direction in FIG. 1 while sliding along the surface of the heater.

When the sheet P to which the toner image was transferred is sent to the fixing means 12, the sheet is guided by an entrance guide 12*f* to enter into the fixing nip where the sheet is pinched between the rotating cylindrical film 12*c* and pressure roller 12*d*, with the result that the sheet is closely contacted with the undersurface of the ceramic heater 12*b* via the film 12*c* to pass through the fixing nip in an overlapped relation with the film 12*c*.

While the sheet is passing through the fixing nip, the non-fixed toner image on the sheet P is heated by the heat transmitted from the ceramic heater 12b to the film 12c, thereby fixing the toner image onto the sheet. The sheet P left the fixing nip is separated from the surface of the rotating film 12c and then is guided by an exit guide 12g to reach the convey roller 10f.

Next, an image forming operation of the above-mentioned image forming apparatus A will be explained with reference to FIG. 1. First of all, the process cartridge B is mounted to the image forming apparatus and the sheet cassette 9 containing the sheets P is loaded in the apparatus. In this condition, when a record start signal is emitted from the apparatus, the pick-up roller 10a and the convey roller 10b are driven. As a result, the sheets P in the sheet cassette 9 are separated one by one by the separation pawl 9f, and the separated sheet is supplied while being guided by the shield plate 14c of the electric unit 14. After the sheet is turned up along the convey roller 10b, the lower surface of the sheet is guided by the guide portion 15j and the upper surface of the sheet is guided by the guide member 10k to reach the image forming portion.

When the tip end of the sheet P is detected by the regist sensor S1, the image is formed in the image forming portion in synchronous with the convey timing that the sheet is conveyed from the regist sensor S1 to the transfer nip portion. That is to say, the photosensitive drum 2 is rotated in the clockwise direction in FIG. 1 in synchronous with the convey timing for the sheet P, during which the surface of the photosensitive drum 2 is uniformly charged by applying the charge bias to the charge roller 3a. Then, the laser light from the optical system 8 is illuminated onto the surface of the photosensitive drum 2 in response to the image signal, thereby forming a latent image corresponding to the light image on the photosensitive drum.

At the same time when the latent image is formed, the developing means 4 of the process cartridge B is driven so that the toner in the toner reservoir 4a is sent to the developing sleeve 4d by the toner feed member 4b and the toner layer is formed on the rotating developing sleeve 4d. By applying the voltage having the same polarity and substantially the same potential as the charging polarity of the photosensitive drum 2 to the developing sleeve 4d, the latent image on the photosensitive drum 2 is developed as the toner image. By applying the voltage having the polarity opposite to that of the toner to the transfer roller 11, the toner image on the photosensitive drum 2 is transferred onto the sheet P sent to the transfer nip.

After the toner image is transferred to the sheet P, the photosensitive drum 2 continues to rotate in the clockwise direction in FIG. 1, and the residual toner remaining on the photosensitive drum 2 is removed by the cleaning blade 5a to be collected in the waste toner reservoir 5c.

On the other hand, the sheet P to which the toner image was transferred is conveyed to the fixing means 12 while being guide by the cover guide 10e. In the fixing means 12, the heat and pressure are applied to the sheet P, thereby the toner image is fixed to the sheet P. After the fixing, the sheet is turned up by the relay discharge roller 10f and the sheet path 10g while correcting the curl in the sheet by bending the sheet, and then, the sheet is discharged in the discharge portion 10j by the pair of discharge rollers 10h, 10i.

Incidentally, in the illustrated embodiment, while an example that the regulating member 9h is positioned with respect to the cassette body 9a by the engagement between the locking groove 9i formed in the cassette body 9a and the engagement portion 9h4 of the regulating member 9h and the fitting engagement between the positioning holes 9m1 to 9m5 formed in the cassette body 9a and the positioning bosses 9h7 of the regulating member 9h was explained, the present invention is not limited to such example. For example, the positioning holes may be formed in one of the regulating member 9h and the cassette body 9a and the positioning bosses may be formed on the other of the regulating member 9h and the cassette body 9a so that the regulating member 9h can be positioned in accordance with the size of the sheet by fitting the positioning boss into the positioning hole.

Further, in the illustrated embodiment, while an example that the urging means for urging the lateral edge of the sheet stack toward the reference surface is constituted by the first and second arm-shaped lateral edge urging portions 9h1, 9h2 and the urging force of the urging portions is obtained by the spring feature of the synthetic resin was explained, the present invention is not limited to this example. For example, the urging force may be obtained by utilizing an elastic force of an elastic member such as a spring, rubber, sponge or the like. Further, the urging means may not be arm-shaped.

In addition, in the illustrated embodiment, while the sheets were separated by the separation pawl 9f, other separation methods may be used. For example, a separation method wherein the sheets are separated between a friction pad and a sheet supply roller, or a separation method wherein the sheets are separated between a sheet supply roller and a reverse rotation roller may be adopted.

What is claimed is:

1. A sheet contain device for containing sheets fed by sheet supply means, comprising:

sheet supporting means for supporting sheets;

a reference member for positioning the sheets by causing one lateral edge of the sheets supported on said sheet supporting means to abut thereagainst; and a regulating member for regulating both of the other lateral edge and a rear edge of the sheets, said regulating means including a lateral edge urging portion for urging the other lateral edge of the sheets toward said reference member, and a rear end regulating portion for regulating the rear end of the sheets.

2. A sheet contain device according to claim 1, further comprising positioning means for positioning said regulating member in a position depending upon a size of the sheets supported by said supporting means.

3. A sheet contain device according to claim 2, wherein said positioning means comprises a positioning boss formed on one of said sheet supporting means and said regulating member, and a positioning hole formed in the other of said sheet supporting means and said regulating member and into which said positioning boss is fitted.

4. A sheet contain device according to claim 2, wherein said positioning means comprises, a slide mechanism including a locking groove formed in said sheet supporting means, and a protruded engagement portion formed on said regulating member and slidably engaged by said locking groove; and a positioning mechanism including a positioning hole formed in said sheet supporting means, and positioning boss formed on said regulating member and adapted to position said regulating member in the position corresponding to the size of the sheet by fitting into said positioning hole.

5. A sheet contain device according to claim 2, wherein said regulating member can be attached so that said rear end regulating portion protrudes from a rear end of said sheet supporting means, and said regulating member has a support surface for partially supporting a rear portion of the sheet when said regulating member is so attached.

6. A sheet contain device according to claim 1, wherein said sheet supporting means comprises a sheet cassette which can contain the sheet therein and which can removably be mounted to an image forming apparatus, and said sheet cassette has a cassette body, and a plate pivotally mounted in said cassette body and adapted to support a tip end portion of the sheet.

7. A sheet contain device according to claim 1, wherein said regulating member includes a sheet number limiting means for limiting the number of sheets which can be supported by said sheet supporting means.

8. A sheet contain device according to claim 1, further comprising size index means provided on said regulating member, and size indication means provided in a position corresponding to said size index means of said regulating member positioned in accordance with the size of the sheet supported by said sheet supporting means, and wherein said regulating member is coincided with the position in accordance with the size of the sheet by aligning said size index means of said regulating member with said size indication means representative of the size of the sheet supported by said sheet supporting means.

9. A sheet feed device comprising:

sheet supporting means for supporting a sheet;

sheet supply means for feeding out the sheet supported by said sheet supporting means;

reference means having a reference surface for guiding one lateral edge of the sheet when the sheet is fed out by said sheet supply means;

urging means for urging the other lateral edge of the sheet supported by said sheet supporting means toward said reference surface; and a rear end regulating member for regulating a rear end of the sheet supported by said sheet supporting means;

wherein said urging means and said rear end regulating member are integrally formed.

10. A sheet feed device according to claim 9, wherein an urging force of said urging means is set so that the greater the urging force the longer a length of the sheet in an urging direction.

11. A sheet feed device according to claim 9, further comprising positioning means for positioning said regulating member to a position in accordance with the size of the sheets supported by said sheet supporting means.

12. A sheet feed device according to claim 9, wherein said urging means comprises a pair of arms extending along the other lateral edge of the sheet, and the other lateral edge of the sheet is urged by said arms.

13. A sheet feed device according to claim 12, wherein said arms are formed from synthetic resin, and the sheet is urged by a spring feature of the synthetic resin.

14. A sheet feed device comprising:

sheet supporting means for supporting a sheet;

sheet supply means for feeding out the sheet supported by said sheet supporting means;

reference means having a reference surface for guiding one lateral edge of the sheet when the sheet is fed out by said sheet supply means;

separation means provided at the side of said reference means and adapted to separate the sheet fed out by said sheet supply means; and regulating means integrally including urging means for urging the other lateral edge of the sheet supported by said sheet supporting means toward said reference surface, and a rear end regulating member for regulating a rear end of the sheet supported by said sheet supporting means;

wherein said regulating means and said separation means are arranged on both sides of a diagonal line of the sheet supported by said sheet supporting means.

15. A sheet feed device according to claim 14, wherein said regulating means has an L-shape obtained by arranging said urging means adjacent to said rear end regulating member, and is arranged in correspondence to one of rear corners of the sheet.

16. A sheet feed device according to claim 15, wherein said separation means comprises a separation pawl engageable with one corner of the sheet supported by said sheet supporting means at a side of said reference means.

17. A sheet feed device according to claim 16, wherein said separation pawl has a regulating portion for regulating a tip end of the sheet supported by said sheet supporting means, and a position of the sheet supported by said sheet supporting means in a sheet feed direction is regulated by said regulating portion and said rear end regulating member of said regulating means.

18. A sheet feed device according to claim 16, wherein said sheet supply means is arranged to offset toward said reference means with respect to a center of the sheet feed direction.

19. A sheet feed device according to claim 18, wherein said urging means comprises a pair of arms extending along the other lateral edge of the sheet and adapted to urge the other lateral edge of the sheet, and an urging force of said arm for urging a front portion of the sheet in the sheet feed direction is set to be greater than an urging force of said arm for urging a rear portion of the sheet.

20. An image forming apparatus comprising:

sheet supporting means for supporting sheets;

a reference member for positioning the sheets by causing one lateral edge of the sheets supported on said sheet support means to abut thereagainst; and a regulating member for regulating both of the other lateral edge and a rear edge of the sheets, said regulating member including a lateral edge urging portion for urging the other lateral edge of the sheets toward said reference member, and a rear end regulating portion for regulating the rear end of the sheets;

sheet supply means for feeding out the sheets supported by said sheet supporting means; and image forming means for forming images on the sheets fed out by said sheet supply means.

21. An image forming apparatus comprising:

image forming means for forming an image on a sheet;

sheet supporting means for supporting sheets to be supplied to said image forming means;

sheet supply means for feeding out each sheet from the sheets supported by said sheet supporting means;

a reference member having a reference surface for guiding one lateral edge of the sheet when the sheet is fed out by said sheet supply means; and a rear end regulating member for regulating the other lateral edge and a rear end of the sheets, said regulating member including a lateral edge urging portion for urging the other lateral edge of the sheets toward said reference member, and a rear end regulating portion for regulating the rear end of the sheets;

wherein said urging portion and said rear end regulating member are integrally formed.

22. An image forming apparatus comprising:

image forming means for forming an image on a sheet;

sheet supporting means for supporting sheets to be supplied to said image forming means;

sheet supply means for feeding out the sheet supported by said sheet supporting means;

a reference member having a reference surface for guiding one lateral edge of the sheet when the sheet is fed out by said sheet supply means;

separation means provided at the side of said reference member and adapted to separate the sheet fed out by said sheet supply means; and regulating means integrally including an urging means for urging the other lateral edge of the sheet supported by said sheet supporting means toward said reference surface and a rear end regulating member for regulating a rear end of the sheet supported by said sheet supporting means;

wherein said regulating means and said separation means are arranged on both sides of a diagonal line of the sheet supported by said sheet supporting means.

* * * * *

UNITED STATES PATENT AND TRADEMARK OFFICE

CERTIFICATE OF CORRECTION

PATENT NO. : 5,433,427

DATED : July 18, 1995

INVENTOR(S) : NORIYOSHI ISHIKAWA, ET AL.

It is certified that error appears in the above-indentified patent and that said Letters Patent is hereby corrected as shown below:

Column 8

Line 68, "this-way" should read --this way--.

Column 11

Line 5, "left" should read --left of--.

Column 11

Line 61, "guide" (first occurrence) should read --guided--.

Signed and Sealed this

Nineteenth Day of December, 1995

Bruce Lehman

*Attest:*

BRUCE LEHMAN

*Attesting Officer*

*Commissioner of Patents and Trademarks*